United States Patent [19]

Lambert, Jr. et al.

[11] 4,322,071

[45] Mar. 30, 1982

[54] STANDING VERTICAL LEG CURL

[76] Inventors: Lloyd J. Lambert, Jr.; Lloyd J. Lambert, Sr., both of 1538 College Ave., South Houston, Tex. 77587

[21] Appl. No.: 73,509

[22] Filed: Sep. 7, 1979

[51] Int. Cl.[3] ..... A63B 21/06

[52] U.S. Cl. ..... 272/118

[58] Field of Search ..... 272/118, 134, 143, DIG. 4, 272/93

[56] References Cited

U.S. PATENT DOCUMENTS

| | | | |
|---|---|---|---|
| 3,120,954 | 2/1964 | Apostol | 272/134 X |
| 4,149,714 | 4/1979 | Lambert | 272/134 X |
| 4,183,520 | 3/1978 | Chase | 272/143 |
| 4,195,834 | 4/1980 | Lambert | 272/118 |

OTHER PUBLICATIONS

Universal Thigh-Knee Machines, Universal Gym Machines, p. 28, 1974.

Dyna Cam, Dynamics Health Equipment Manufacturing Co., Inc., 1979 edition, p. 2.

*Primary Examiner*—Richard C. Pinkham

*Assistant Examiner*—William R. Browne

*Attorney, Agent, or Firm*—Victor J. Evans & Co.

[57] ABSTRACT

Disclosed herein is a standing vertical leg curl machine including a framework having a base and a plurality of upstanding vertical support members interconnected by horizontal braces, a pair of spaced thigh pads connected to a thigh bar having an adjustable interfit between complimentary formed tubes carried on the framework provided with a locking device for adjustment, a downwardly and outwardly extending exercise arm fashioned between the pair of thigh pads having at extremity remote from a pivot and sprocket carried on the framework a pair of transverse pads which co-act against the back portion of the calves of a person using the exercise device when the thighs of this person address the thigh pads. The sprocket is connected to a second sprocket formed with a cam provided with a weight and cable system which works against an exerciser when the legs are curled towards the back of the person.

7 Claims, 3 Drawing Figures

STANDING VERTICAL LEG CURL

BACKGROUND OF THE INVENTION

Various machines have been known to exist which develop leg muscles, one of which comprises a horizontal planar bench upon which a person lies face first and, co-acting with the calf area of the leg, a transverse pad connected to a pivot arm and thereafter to plurality of weights for exercise by rotating the pivot arm about a pivot point.

The effectiveness of this exercise and the ease with which it can be performed depends greatly on the degree of offset between the horizontal planar bench and pad members. Clearly, a person with rather large thighs when compared to a more slender person would find that one machine given this arrangement could not assure that the starting point of the exercise will be the same for all people, due to the necessity of rotating the exercise arm partially so that one's legs can get between the planar bench and the pads.

Apart from the assurance that such a machine cannot provide uniform workouts for all people except those which define an adeal after that which the machine was patterned, maximum benefits cannot uniformly be obtained.

SUMMARY OF THE INVENTION

Accordingly, the ensuing detailed description provides a machine which can alter the distance between the constraint applied on a front face of a leg and the area where the pad engages the calf area so that work done by individuals of different dimensions can be most beneficial and uniform.

A further object of this invention is to provide a machine of the character described above which is safe to use, reliable in operation, and easy to adjust.

These and other objects will be made manifest when considering the following detailed specification when accompanied with the appended drawings.

BRIEF DESCRIPTION OF THE PREFERRED EMBODIMENT

Figure 1:
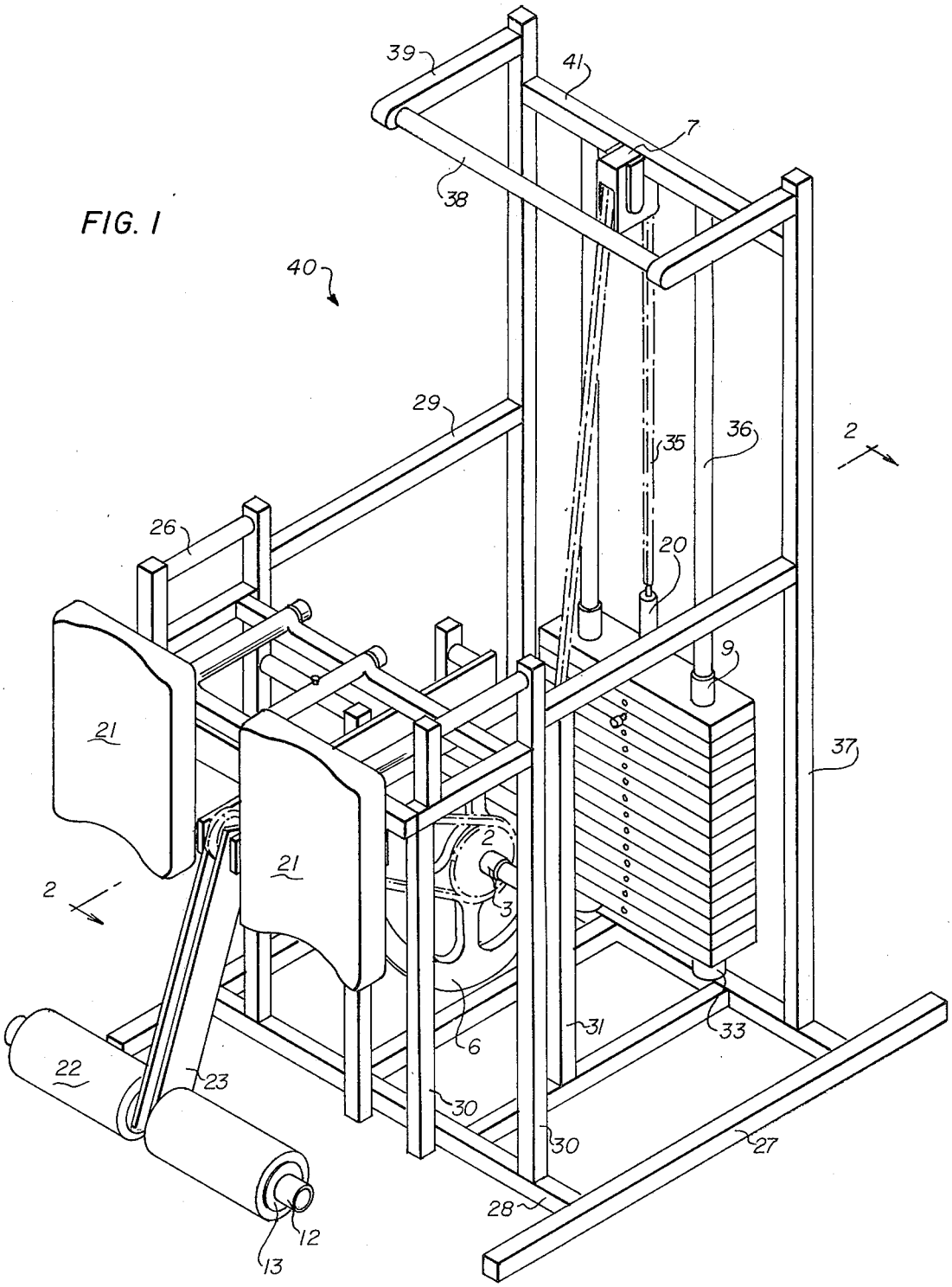
FIG. 1 is a perspective view of the apparatus according to the present invention.

Referring now to the drawings in detail, wherein like reference numerals refer to like parts, reference numeral 40 is directed to the standing vertical leg curl machine according to the present invention.

This machine 40 is comprised of a base of substantially rectangular configuration provided with plural spaced parallel rod members 27 interconnected by transverse bars 28, from which emanate vertically upward a multitude of vertical support bars 30, 31, 37.

Figure 3:
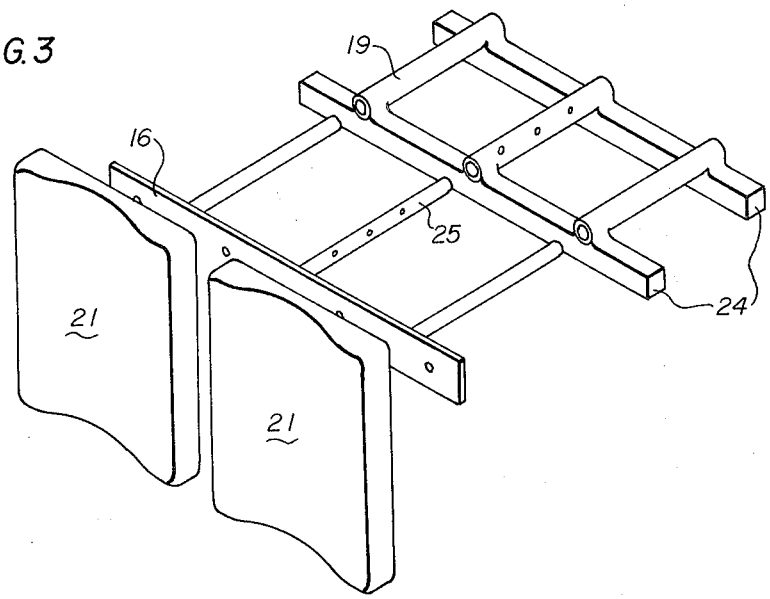
FIG. 3 depicts an adjustable feature for the thigh pads' supports according to the present invention.

Four of these bars bearing the reference numeral 30 comprise a network which serves to support the thigh pad adjusting device best seen in FIG. 3. A pair of spaced parallel bars 24 interconnect four of the vertical supports 30 and transverse to these bars 24 are shown three tubular members 19. The pads 21 are carried on a thigh bar 16 and have a generally flat rear surface, a centrally depressed padded area in the vertical sense on the face remote therefrom which extends to horizontal marginal areas in a thickened portion. The thigh bar 16 is provided with plural parallel rods 25 adapted to be inserted within the tubes 19 as shown in FIG. 3, and when the holes in the central member 19 and rod 25, for example are in registry, a locking pin 17 extends therethrough to constrain the thigh pads from further motion.

Extending between the pair of thigh pads is a horizontal support carried by vertical supports 31, and this horizontal support 32 terminates in a pivot overlying which is a sprocket 1. Extending downwardly and outwardly away from the thigh pads 21 is an exercise arm 23 whose terminal point remote from the sprocket 1 is provided with a pair of transverse pads 22 of cylindrical configuration on either side thereof. The exercise arm as shown in FIG. 2 is L-shaped and a terminal portion 34 thereof abuts against a rubber bumper 33 carried on the horizontal support arm so that the range of motion of the exercise arm 23 is limited. Sprocket 1 communicates with a further sprocket 2 (FIG. 1) by means of a chain 11 having a tension maintaining spring 10 as shown in FIG. 2. Sprocket 2 in turn is supported on a shaft extending between a pair of vertical supports 31 and also supported on this shaft is a D-shaped cam 6 provided with a cable or chain 35 which extends upwardly to a pulley 8 protected in a shroud 7 and downwardly thereafter and terminates in a cable adjuster 20 for removing slack therefrom the cable adjuster 20 terminates within holes provided in a plurality of weights 34 supported on poles 36 through bearings 9 capable of selective engagement by means of pin 14. The overhead pulley 8 is supported on a framework defined by a pair of vertical members 37 interconnected by a brace 41 and further supported by horizontal cross braces 29.

At the vertical extremity of the bars 37 is a handgrip 38 parallel to the support bar 41 extending towards the thigh pads 21 by means of extension arms 39.

Figure 2:
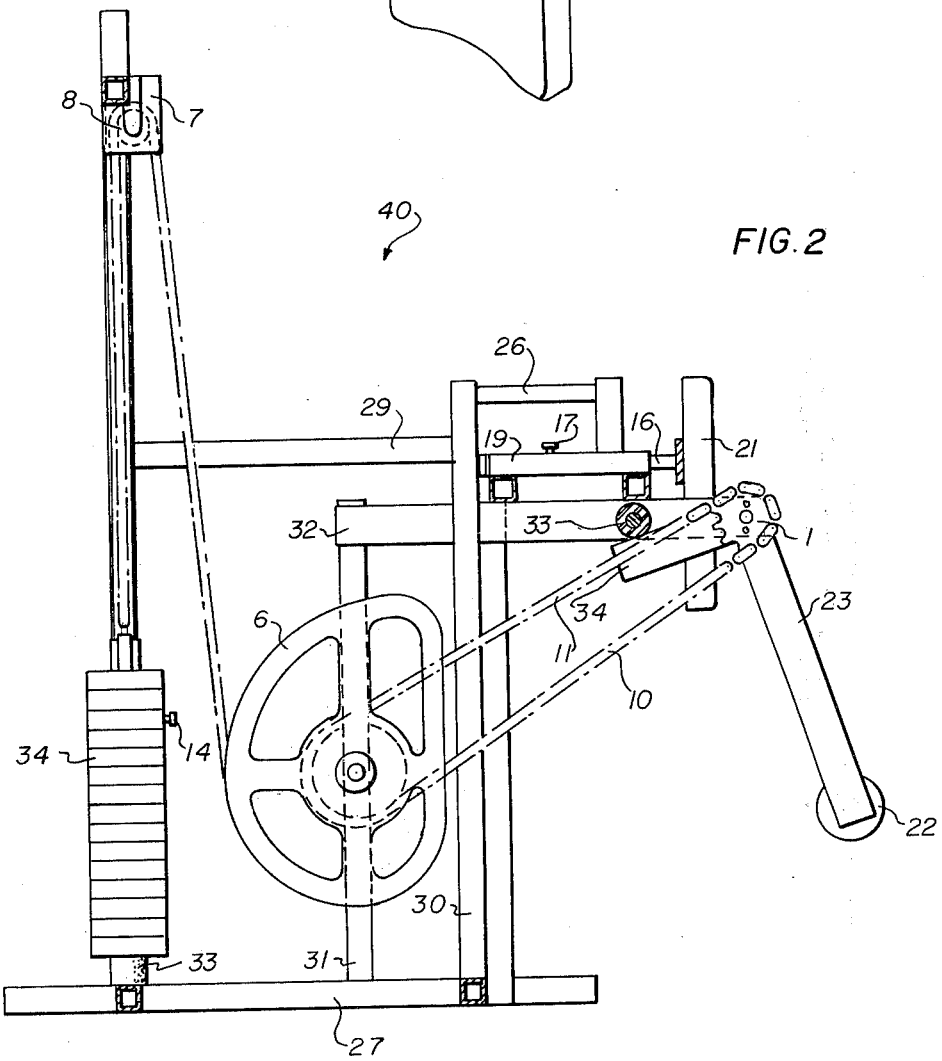
FIG. 2 is a sectional view taken along lines 2—2 of FIG. 1.

A pair of handgrips 26 is disposed parallel to the tubes 19 but somewhat vertically higher as shown in FIG. 1 and these similarly are carried by vertical supports 30.

In view of the foregoing, it should be clear that the distance in one dimension between the thigh pads 21 and the cylindrical pads 22 can be varied by altering the depth within which rods 25 penetrate tubes 19. In this manner, people having legs of various dimensions can address this machine in its initialized state and therefor benefit from a full range of motion in performing a reverse curl operation which in one form would entail pivoting a knee, or alternatively about a hip. Support is provided for the upper torso by means of handgrips 26 or 38 as desired, and although the discussion for the exercise arm 23 specifies a single member, in fact the device may comprise a pair of such members so that when one leg is being curled, the additional weight of the non-used support pad 22 and bar will not be encountered. Further, it should be apparent that the topmost weight 34 in the series of weights may be calibrated so that when that is the sole weight to be used by means of the pin, the net effect of the weight associated with various other components in the system can be counterbalance and therefore negated. Further, it should be noted that the plurality of weights 34 are similarly supported by a rubber bumper stop 33 so as to minimize shock.

Having thus described the invention it should be apparent that numerous structural modifications are contemplated as being a part of this invention as set forth herein above and as defined herein below by the claims.

What is claimed is:

1. A standing vertical leg curl machine comprising: a framework including base members and vertically upstanding support members, a pair of thigh pads carried by said vertical members, a horizontal exercising support carried by said vertical members disposed between said pair of thigh pads, a downwardly and outwardly extending exercise arm pivoted at one end to said horizontal support and having a sprocket a said one end, weight means connect to said sprocket, for movement between a rest position and an elevated position during the rotating of said sprocket and a pair of leg pads transversely disposed on said exercise arm at an extremity remote from said exercise arm one end and laterally spaced from said thigh pads whereby a standing person placing his legs between said thigh pads and said leg pads exercises by moving said exercise arm pivotally upwardly with the legs with concomitant rotation of said sprocket against said weight means.

2. The device of claim 1 wherein said leg pads and said thigh pads are adjustably mounted.

3. The device of claim 2 wherein the distance between said thigh pads and said leg pads is adjusted by said thigh pads, said thigh pads comprise a pair of spaced parallel horizontal support members affixed to said vertical members, transversely disposed tubes thereon, a thigh bar, said pair of thigh pads being secured to said thigh bar parallel to said pair of spaced parallel horizontal support members, transversely disposed rods on said thigh bar for insertion within said tubes, and locking means for affixing said rods in said tubes.

4. The device of claim 3 wherein said locking means comprises a pin element disposed within holes provided in said rods and tubes when said holes are in registry.

5. The device of claim 4 including a rotatably mounted cam and wherein said weight means comprises a second sprocket connected to said cam carried on said framework, a chain extending between said sprockets, and adjustable cable means extending between said cam and plural variable weights.

6. The device of claim 5 wherein a pair of spaced parallel hand grips are provided near and parallel to said tubes.

7. The device of claim 6 wherein a further handgrip mounted on the upper extremity of said framework rearwardly of said thigh pads and extending transverse to said tubes.

* * * * *